US010712703B2

(12) United States Patent
Chen et al.

(10) Patent No.: US 10,712,703 B2
(45) Date of Patent: Jul. 14, 2020

(54) SENSING DEVICE CAPABLE OF DETECTING PAPER JAM CONDITIONS AND OFFICE APPARATUS THEREWITH

(71) Applicant: AVISION INC., Hsinchu (TW)

(72) Inventors: Chi-Yao Chen, Miaoli County (TW); Ku-Ming Chen, Hsinchu County (TW); Chia-Ching Lin, Taichung (TW)

(73) Assignee: AVISION INC., Hsinchu (TW)

( * ) Notice: Subject to any disclaimer, the term of this patent is extended or adjusted under 35 U.S.C. 154(b) by 233 days.

(21) Appl. No.: 16/030,803

(22) Filed: Jul. 9, 2018

(65) Prior Publication Data

US 2019/0018360 A1 Jan. 17, 2019

(30) Foreign Application Priority Data

Jul. 13, 2017 (TW) ..... 106210298 U

(51) Int. Cl.
*G03G 15/00* (2006.01)

(52) U.S. Cl.
CPC ..... *G03G 15/70* (2013.01)

(58) Field of Classification Search
CPC .... G03G 15/703; G03G 15/70; G03G 15/706; G03G 15/6558; G03G 15/6529
See application file for complete search history.

(56) References Cited

U.S. PATENT DOCUMENTS 8,364,071 B2 * 1/2013 Noguchi ..... B65H 5/062 399/397
8,948,679 B2 * 2/2015 Murakami ..... B41J 13/025 399/388
9,359,159 B2 * 6/2016 Noda ..... B65H 7/14
2004/0089996 A1 * 5/2004 Asada ..... B65H 7/18 271/110
2004/0130093 A1 7/2004 Chen
2010/0270738 A1 * 10/2010 Cheng ..... B65H 7/02 271/265.01
2011/0011512 A1 * 1/2011 Lee ..... B32B 41/00 156/64
2014/0312562 A1 * 10/2014 Ueda ..... B65H 7/02 271/265.02
2015/0239695 A1 8/2015 Noda

FOREIGN PATENT DOCUMENTS

CN 105645148 A 6/2016
JP 5-231516 A 9/1993

* cited by examiner

*Primary Examiner* — David H Banh
(74) *Attorney, Agent, or Firm* — Winston Hsu

(57) ABSTRACT

A sensing device includes a housing, a supporting component, a grating module, a first roller, a second roller, and a control unit. When a media contacts with the second roller, the second roller drives the first roller to move the supporting component relative to the housing according to a thickness of the media, so as to adjust positions of the first roller and a grating wheel of the grating module relative to the housing. When the media drives the second roller to rotate, the second roller drives the first roller to rotate the grating wheel. The control unit determines whether the media proceeds at a predetermined speed according to a corresponding sensing signal generated by the grating module during rotation of the grating wheel, which allows a user to recognize a progress state of the media.

13 Claims, 7 Drawing Sheets

SENSING DEVICE CAPABLE OF DETECTING PAPER JAM CONDITIONS AND OFFICE APPARATUS THEREWITH

BACKGROUND OF THE DISCLOSURE

1. Field of the Disclosure

The present disclosure relates to a sensing device and an office apparatus therewith, and more particularly, to a sensing device capable of detecting paper jam conditions and an office apparatus therewith.

2. Description of the Prior Art

With advancement of technology, various office apparatuses are widely used in people's daily lives for helping people deal with paperwork. In order to make sure that paper jam conditions can be solved immediately, a conventional office apparatus is usually provided with a detector disposed on a passage of paper for detecting a paper feeding condition for improving efficiency of printing or copy. The detector usually utilizes a cantilever arm or a linkage to contact with paper to generate a corresponding signal to determine the paper feeding condition. However, such detector may cause interference of feeding or even paper jam conditions, which is not convenience in use.

SUMMARY OF THE DISCLOSURE

Therefore, an objective of the present disclosure is to provide a sensing device capable of detecting paper jam conditions and an office apparatus therewith for solving the aforementioned problems.

In order to achieve the aforementioned objective, the present disclosure discloses a sensing device including a housing, a supporting component, a grating module, a first roller, a second roller and a control unit. The supporting component is movably disposed on the housing. The grating module is installed inside the housing. The grating module includes a grating wheel, a light emitting component and a light receiving component. The grating wheel is rotatably disposed on the supporting component. The light emitting component is for emitting light. The light receiving component is for receiving the light emitted by the light emitting component to generate a corresponding sensing signal. The first roller is disposed coaxially with the grating wheel and for driving the grating wheel to rotate. The second roller contacts with the first roller and is for driving the first roller to rotate. When a media contacts with the second roller, the second roller drives the first roller to move the supporting component relative to the housing according to a thickness of the media, so as to adjust positions of the first roller and the grating wheel relative to the housing, and the second roller drives the first roller to rotate the grating wheel when the media drives the second roller to rotate. The control unit is electrically connected to the light emitting component and the light receiving component. The control unit determines whether the media proceeds at a predetermined speed according to the corresponding sensing signal generated by the light receiving component during rotation of the grating wheel.

According to an embodiment of the present disclosure, the light emitting component and the light receiving component are disposed on the two opposite sides of the grating wheel. A plurality of apertures is formed on a periphery of the grating wheel at intervals, and the light emitted by the light emitting component passes through the plurality of apertures to the light receiving component.

According to an embodiment of the present disclosure, the light emitting component and the light receiving component are disposed on a same side of the grating wheel. A plurality of reflecting sections is formed on a periphery of the grating wheel at intervals, and the light emitted by the light emitting component is reflected to the light receiving component by the plurality of reflecting sections.

According to an embodiment of the present disclosure, the sensing device further includes a recovering component disposed between the supporting component and the housing and for driving the supporting component to recover.

According to an embodiment of the present disclosure, at least one slot is formed on the housing, and the supporting component includes at least one sliding portion slidably installed inside the at least one slot.

According to an embodiment of the present disclosure, when the second roller rotates along a first rotating direction, the second roller drives the first roller to rotate along a second rotating direction opposite to the first rotating direction to simultaneously drive the grating wheel to rotate along the second rotating direction.

In order to achieve the aforementioned objective, the present disclosure further discloses an office apparatus including a main body, a driving roller assembly, and a sensing device. A passage is formed inside the main body. The driving roller assembly is disposed inside the main body and for driving a media to move along the passage. The sensing device is for determining whether the media proceeds along the passage normally. The sensing device includes a housing, a supporting component, a grating module, a first roller, a second roller and a control unit. The housing is disposed inside the main body. The supporting component is movably disposed on the housing. The grating module is installed inside the housing. The grating module includes a grating wheel, a light emitting component and a light receiving component. The grating wheel is rotatably disposed on the supporting component. The light emitting component is for emitting light. The light receiving component is for receiving the light emitted by the light emitting component to generate a corresponding sensing signal. The first roller is disposed coaxially with the grating wheel and for driving the grating wheel to rotate. The second roller contacts with the first roller and is for driving the first roller to rotate. When the media contacts with the second roller, the second roller drives the first roller to move the supporting component relative to the housing according to a thickness of the media, so as to adjust positions of the first roller and the grating wheel relative to the housing, and the second roller drives the first roller to rotate the grating wheel when the media drives the second roller to rotate. The control unit is electrically connected to the light emitting component and the light receiving component. The control unit determines whether the media proceeds at a predetermined speed according to the corresponding sensing signal generated by the light receiving component during rotation of the grating wheel.

According to an embodiment of the present disclosure, the second roller and the driving roller assembly are disposed on two opposite sides of the passage.

In summary, in the present disclosure, when the media proceeds along the passage, the media drives the second roller to rotate the first roller to rotate the grating wheel, so that the control unit can determine whether the media proceeds along the passage at the predetermined speed according to the sensing signal generated by the light receiving component during rotation of the grating wheel. In such a way, such mechanism can determine that a paper jam condition occurs when the control unit determines the media does not process along the passage at the predetermined speed. Furthermore, in the present disclosure, there is only the second roller rotatably contacting with the media, which effectively prevents interference of feeding and reduces a possibility of the paper jam condition.

These and other objectives of the present disclosure will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the disclosure may be practiced. In this regard, directional terminology, such as "top," "bottom," "front," "back," etc., is used with reference to the orientation of the Figure(s) being described. The components of the present disclosure can be positioned in a number of different orientations. As such, the directional terminology is used for purposes of illustration and is in no way limiting. Accordingly, the drawings and descriptions will be regarded as illustrative in nature and not as restrictive.

Figure 1:
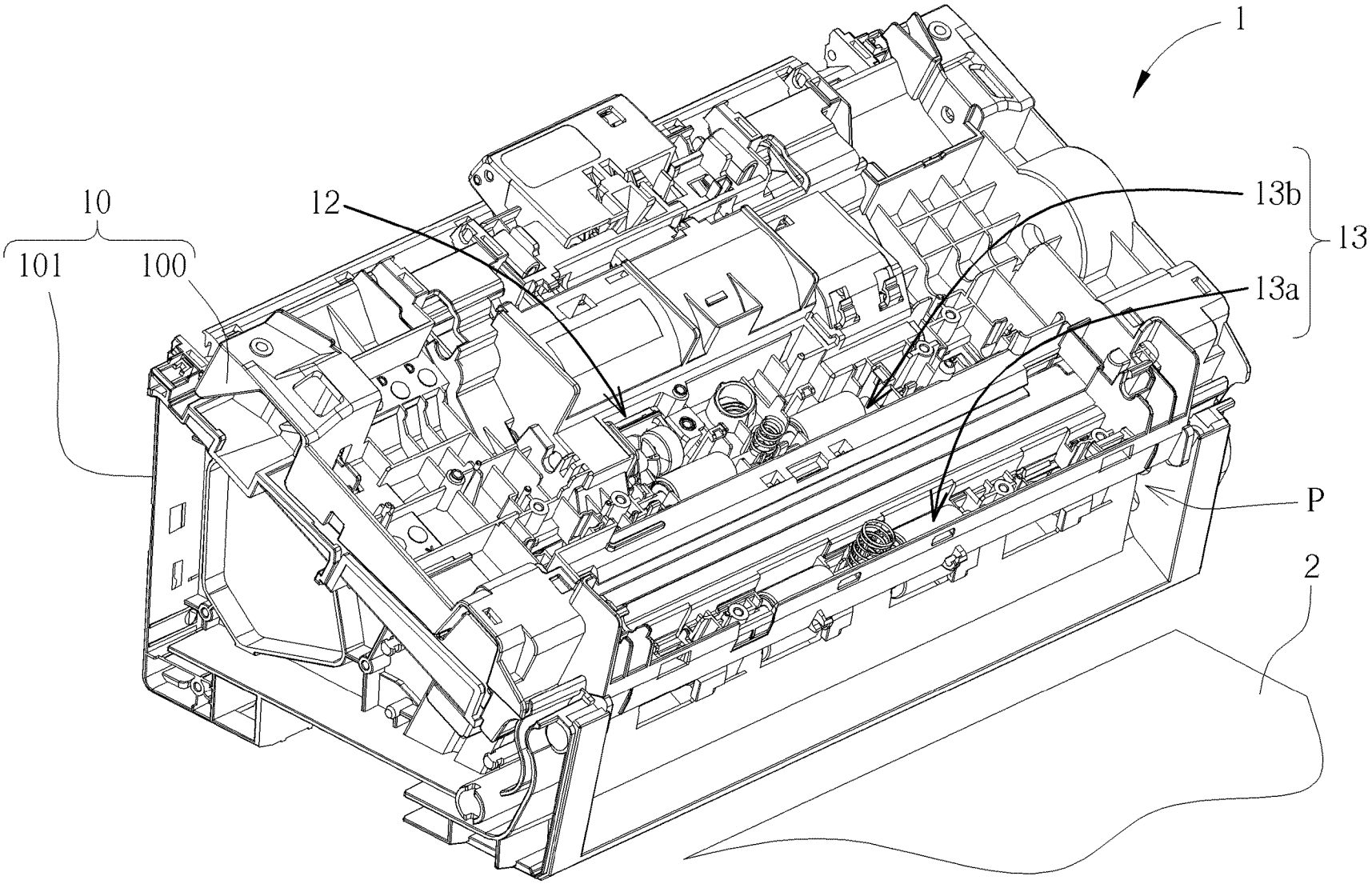
FIG. 1 is a partial internal structural diagram of an office apparatus according to an embodiment of the present disclosure.
Figure 2:
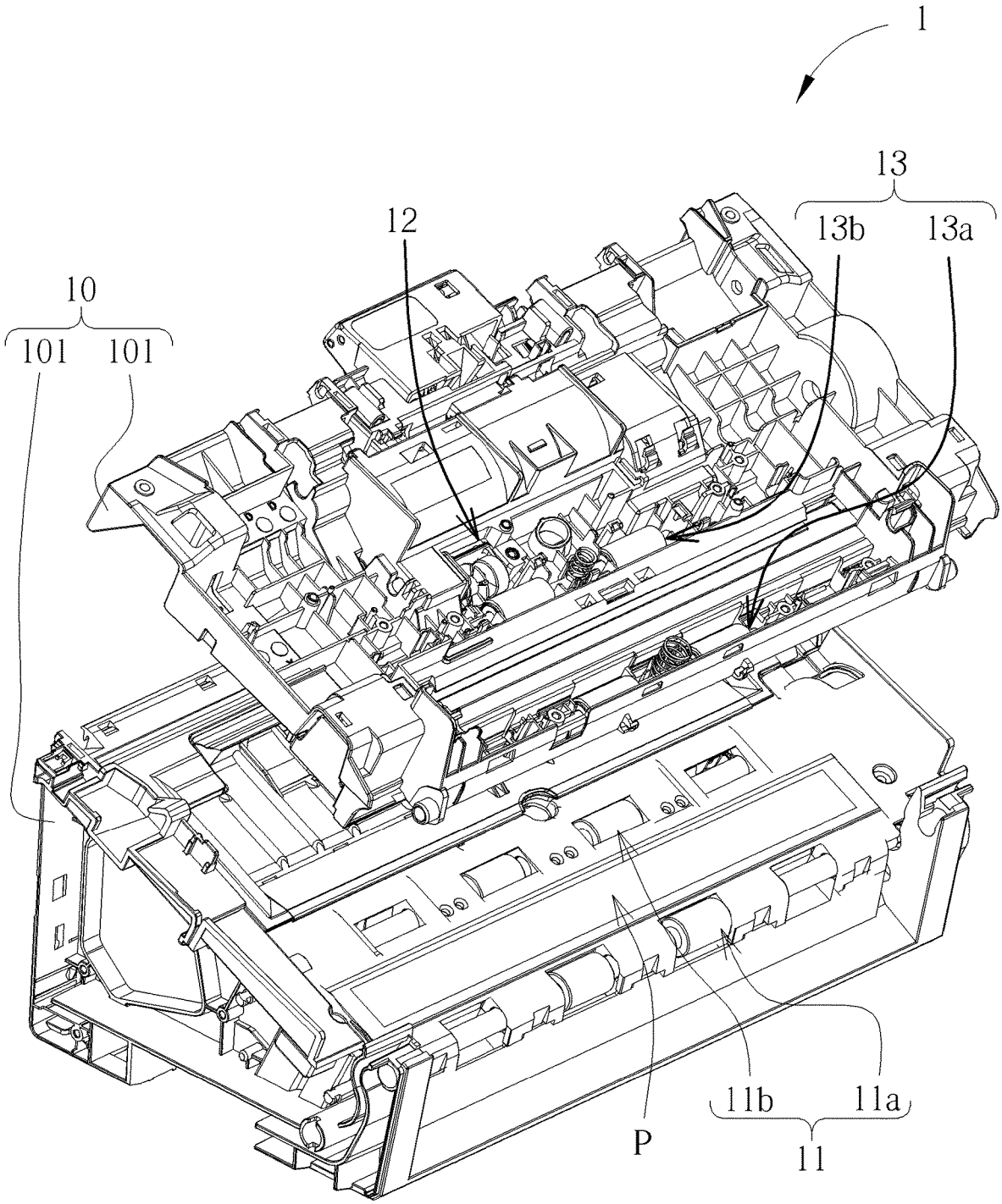
FIG. 2 is a partial exploded diagram of the office apparatus according to the embodiment of the present disclosure.

Please refer to FIG. 1 and FIG. 2. FIG. 1 is a partial internal structural diagram of an office apparatus 1 according to an embodiment of the present disclosure. FIG. 2 is a partial exploded diagram of the office apparatus 1 according to the embodiment of the present disclosure. In this embodiment, the office apparatus 1 can be scanning equipment, copy equipment, printing equipment, or multi-function equipment having the aforementioned functions. As shown in FIG. 1 and FIG. 2, the office apparatus 1 includes a main body 10, a driving roller assembly 11, a sensing device 12 and a driven roller assembly 13. The main body 10 includes an outer shell, which is not shown in figures, an upper assembly 100 and a lower assembly 101. The upper assembly 100 and the lower assembly 101 are installed inside the outer shell. A passage P is formed between the upper assembly 100 and the lower assembly 101 for allowing a media 2, such as paper, to pass therethrough. The driving roller assembly 11 includes a first driving assembly 11*a* and a second driving assembly 11*b* disposed on the lower assembly 101 for driving the media 2 to proceed along the passage P.

The driven roller assembly 13 includes a first driven assembly 13*a* and a second driven assembly 13*b* movably disposed on the upper assembly 100 and located at positions corresponding to the first driving assembly 11*a* and the second driving assembly 11*b* of the driving roller assembly 11 respectively. The driven roller assembly 13 is for resiliently pressing the media 2 downwardly when the driving roller assembly 11 drives the media 2 to proceed along the passage P. The sensing device 12 is disposed on the upper assembly 100 and for determining whether the media 2 proceeds along the passage P normally. In other words, in this embodiment, the driving roller assembly 11 and the sensing device 12 can be located two opposite sides of the passage P. However, it is not limited thereto. For example, in another embodiment, the driving roller assembly 11 and the sensing device 12 also can be located at a same side of the passage P. It depends on practical demands.

Figure 3:
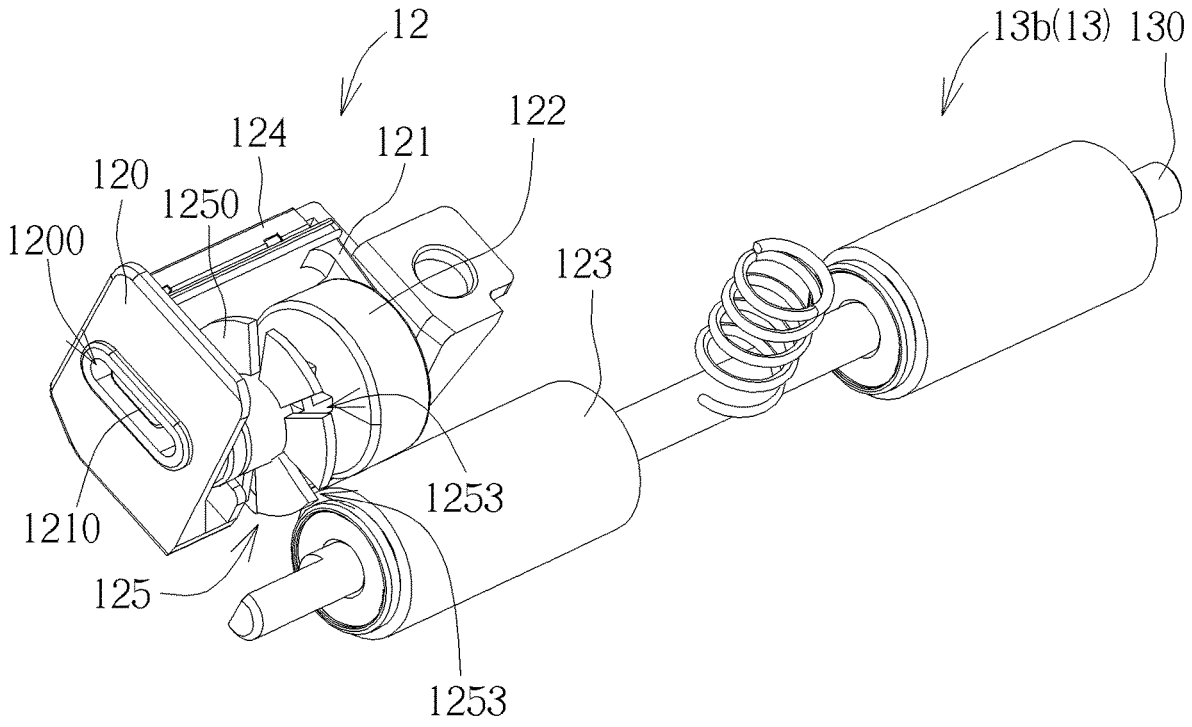
FIG. 3 is a diagram of a sensing device and a driven roller assembly according to the embodiment of the present disclosure.
Figure 4:
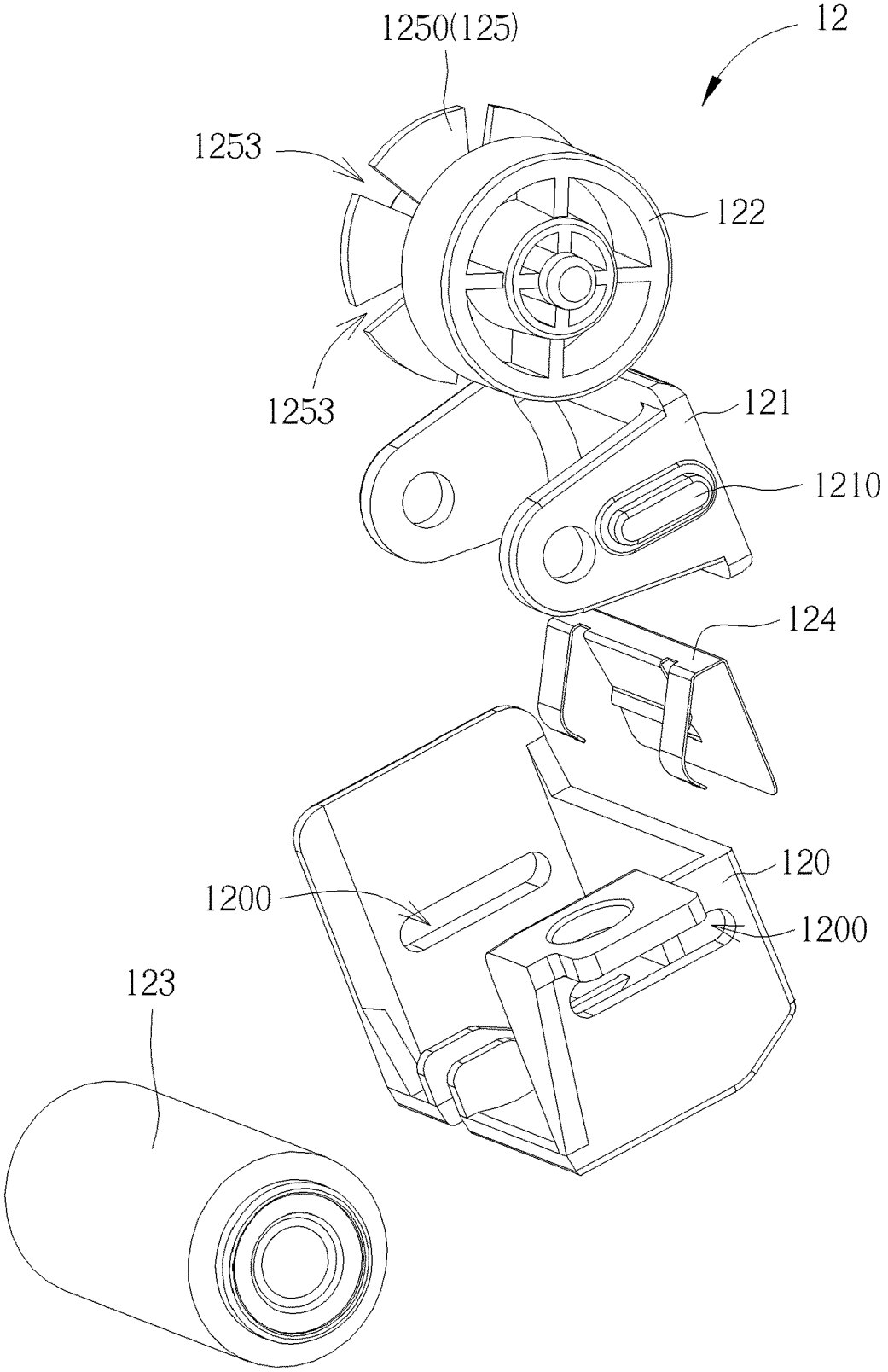
FIG. 4 is an exploded diagram of the sensing device according to the embodiment of the present disclosure.

Please refer to FIG. 1 to FIG. 4. FIG. 3 is a diagram of the sensing device 12 and the driven roller assembly 13 according to the embodiment of the present disclosure. FIG. 4 is an exploded diagram of the sensing device 12 according to the embodiment of the present disclosure. As shown in FIG. 1 to FIG. 4, the sensing device 12 includes a housing 120, a supporting component 121, a first roller 122, a second roller 123 and a recovering component 124. The housing 120 is disposed on the upper assembly 100. The supporting component 121 is movably disposed on the housing 120. The recovering component 124 is disposed between the supporting component 121 and the housing 120 and for driving the supporting component 121 to recover. The recovering component 124 can be a resilient clip. The first roller 122 is rotatably disposed on the supporting component 121. The second roller 123 contacts with the first roller 122 and is for driving the first roller 122 to rotate.

Specifically, in this embodiment, two slots 1200 are formed on the housing 120. The supporting component 121 includes two sliding portions 1210. The two sliding portions 1210 of the supporting component 121 are slidably installed within the two slots 1200 on the housing 120, which allows the supporting component 121 to move relative to the housing 120. However, structures of the housing 120 and the supporting component 121 are not limited to this embodiment. That is, mechanism which allows the supporting component 121 to move relative to the housing 120 is included within the scope of the present disclosure. Furthermore, the second roller 123 is installed on a pivoting shaft 130 of the second driven assembly 13*b* of the driven roller assembly 13. When the media 2 proceeds along the passage P, the media 2 pushes the driven roller assembly 13 and the second roller 123 to adjust a position of the second roller 123 relative to the upper assembly 100 according to a thickness of the media 2, so that the first roller 122 is driven by the second roller 123 to move the supporting component 121 relative to the housing 120. However, structures of the housing 120, the supporting component 121 and the second roller 123 of the present disclosure are not limited to the figures of this embodiment. It depends on practical demands. For example, the second roller 123 can be separated from the driven roller assembly 13 and still resiliently press the media 2 downwardly when the media 2 proceeds along the passage P.

Figure 5:
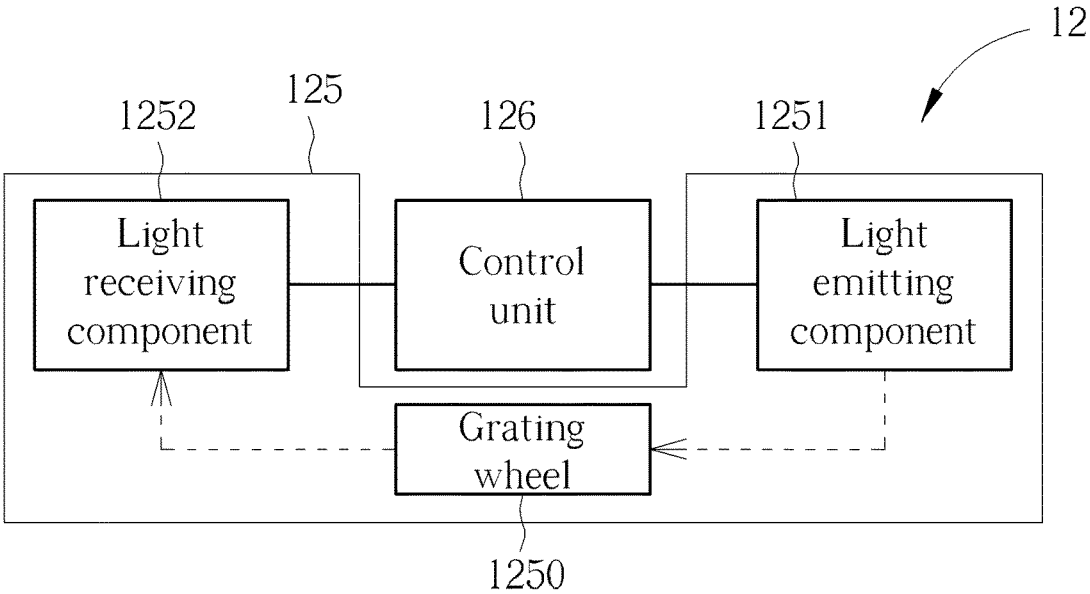
FIG. 5 is a functional block diagram of the sensing device according to the embodiment of the present disclosure.

Please refer to FIG. 3 to FIG. 5. FIG. 5 is a functional block diagram of the sensing device 12 according to the embodiment of the present disclosure. As shown in FIG. 3 to FIG. 5, the sensing device further includes a grating module 125 and a control unit 126. The grating module 125 is installed inside the housing 120 and includes a grating wheel 1250, a light emitting component 1251 and a light receiving component 1252. The grating wheel 1250 is disposed coaxially with the first roller 122 and rotatable along with the first roller 122. The control unit 126 is electrically connected to the light emitting component 1251 and the light receiving component 1252. The light emitting component 1251 is for emitting light toward the grating wheel 1250. The light receiving component 1252 is for receiving the light emitted by the light emitting component 1251 to generate a corresponding sensing signal. The control unit 126 determines whether the media 2 proceeds along the passage P at a predetermined speed according to the sensing signal generated by the light receiving component 1252 during rotation of the grating wheel 1250, so as to determine whether a paper jam condition occurs inside the passage P.

Figure 6:
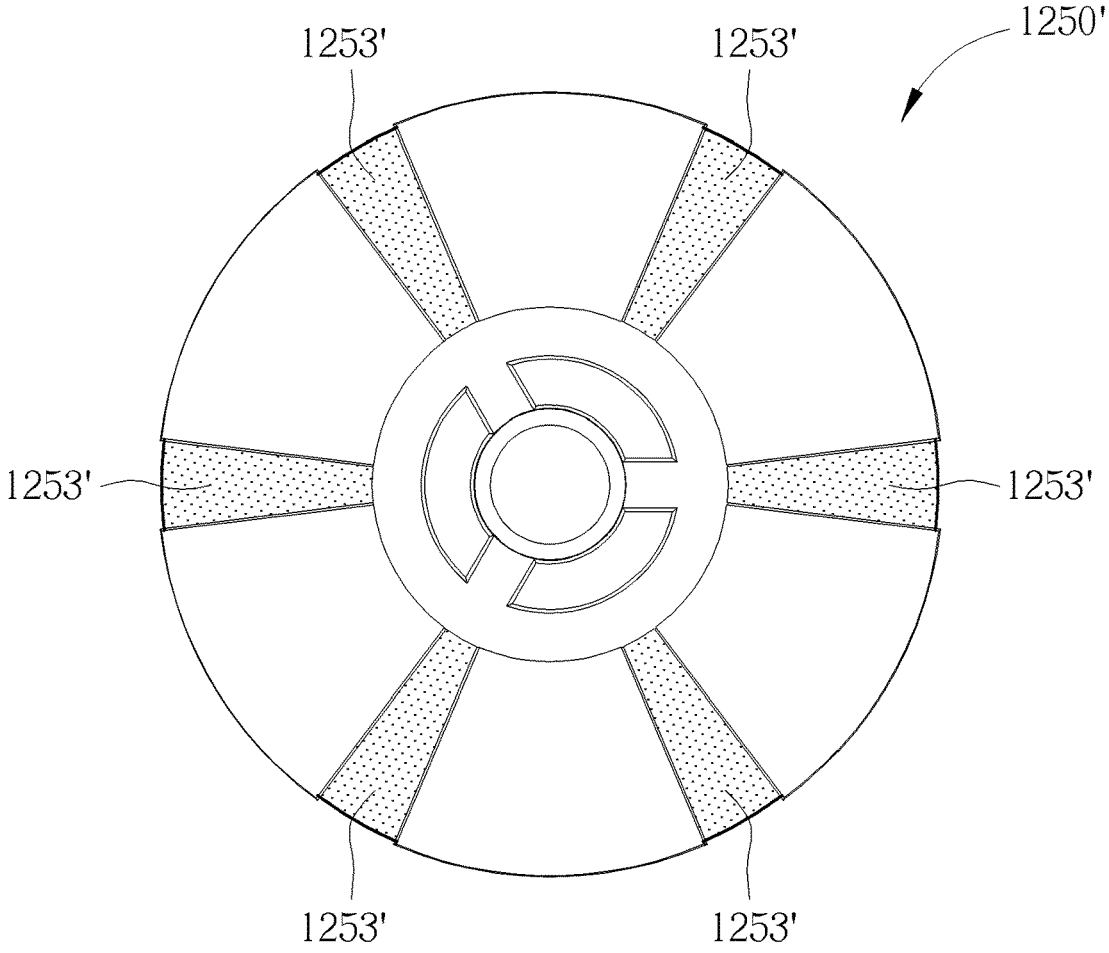
FIG. 6 is a diagram of a grating wheel according to another embodiment of the present disclosure.

Furthermore, it should be noticed that, in this embodiment, the light emitting component 1251 and the light receiving component 1252 can be disposed on two opposite sides of the grating wheel 1250. A plurality of apertures 1253 is formed on a periphery of the grating wheel 1250 at intervals. When the grating wheel 1250 rotates, the light emitted by the light emitting component 1251 passes through the plurality of apertures 1253 to the light receiving component 1252, so that the light receiving component 1252 generates the corresponding sensing signal. Therefore, the control unit 126 can determine whether the media 2 proceeds along the passage P at the predetermined speed according to the sensing signal generated by the light receiving component 1252 during rotation of the grating wheel 1250, so as to determine whether a paper jam condition occurs inside the passage P. However, structures of the light emitting component 1251, the light receiving component 1252 and the grating wheel 1250 are not limited to this embodiment. For example, please refer to FIG. 6. FIG. 6 is a diagram of a grating wheel 1250' according to another embodiment of the present disclosure. As shown in FIG. 6, in this embodiment, a plurality of reflecting sections 1253' is formed on a periphery of a grating wheel 1250' at intervals. The light emitting component 1251 and the light receiving component 1252 can be disposed on a same side of the grating wheel 1250'. Therefore, when the grating wheel 1250' rotates, the light emitted by the light emitting component 1251 is reflected to the light receiving component 1252 by the plurality of reflecting sections 1253', so that the light receiving component 1252 generates the corresponding sensing signal. Therefore, the control unit 126 can determine whether the media 2 proceeds along the passage P at the predetermined speed according to the sensing signal generated by the light receiving component 1252, so as to determine whether a paper jam condition occurs inside the passage P.

Figure 7:
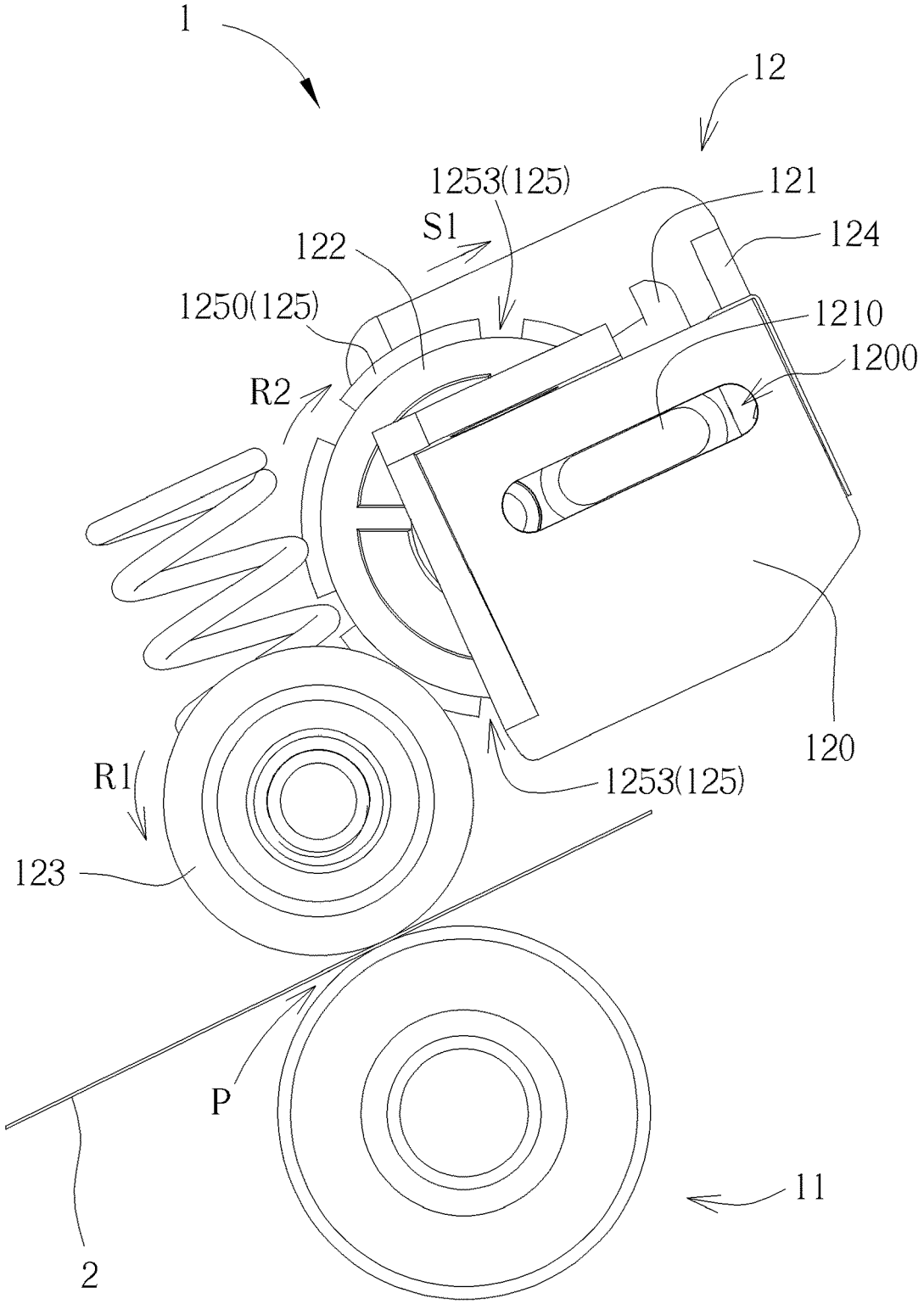
FIG. 7 and FIG. 8 are diagrams of the office apparatus at different states according to the embodiment of the present disclosure.
Figure 8:
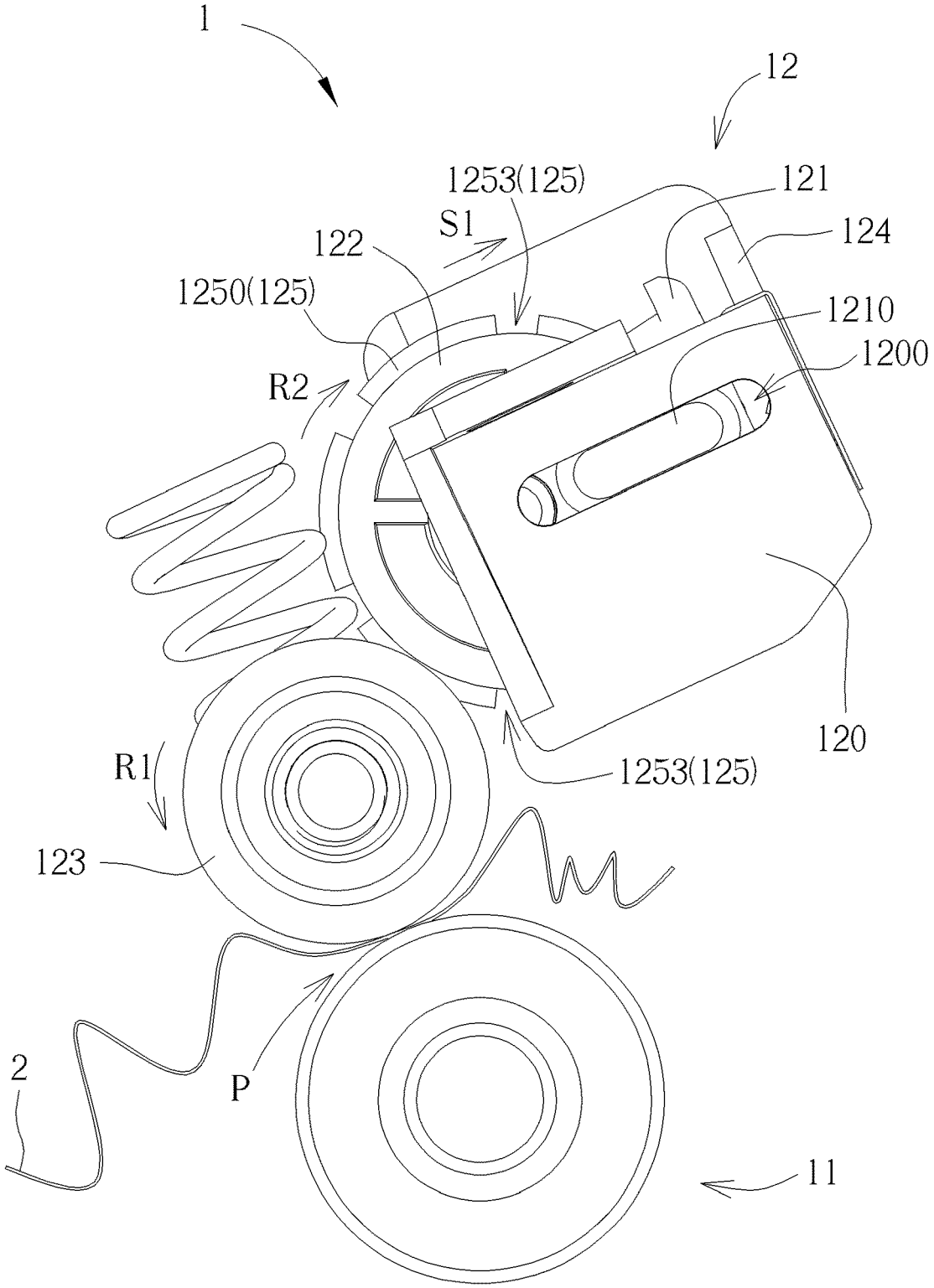

Operational principle of the office apparatus 1 of the present disclosure is described as follows. Please refer to FIG. 2, FIG. 7 and FIG. 8. FIG. 7 and FIG. 8 are diagrams of the office apparatus 1 at different states according to the embodiment of the present disclosure. In order to illustrate the operational principle of the office apparatus 1 more specifically, FIG. 7 and FIG. 8 only illustrate partial components of the office apparatus 1. As shown in FIG. 2 and FIG. 7, when the media 2 is driven by the driving roller assembly 11 to proceed along the passage P at a predetermined speed, the media 2 contacts with the second roller 123 to move the second roller 123 relative to the upper assembly 100 according to the thickness of the media 2, so that the first roller 122 is driven by the second roller 123 to move the supporting component 121 relative to the housing 120 along a moving direction S1 to adjust positions of the first roller 122 and the grating wheel 1250 relative to the housing 120. When the media 2 proceeds along the passage P, the media 2 drives the second roller 123 to rotate along a first rotating direction R1 by a frictional force therebetween, so that the first roller 122 is driven by the second roller 123 to rotate the grating wheel 1250 along a second rotating direction R2 opposite to the first rotating direction R1 at a predetermined rotating speed corresponding to the predetermined speed. When the grating wheel 1250 rotates along the second rotating direction R2 at the predetermined rotating speed, the light emitted by the light emitting component 1251 can correctly pass through the plurality of apertures 1253 to the light receiving component 1252, so that the light receiving component 1252 generates a sensing signal corresponding to the predetermined rotating speed. Therefore, the control unit 126 can determine that the media 2 proceeds along the passage P at the predetermined speed according to the sensing signal generated by the light receiving component 1252, so as to determine no paper jam condition occurs inside the passage P.

On the other hand, as shown in FIG. 8, when a paper jam condition occurs inside the passage P, a proceeding speed of the media 2 is not identical to the predetermined speed because the media 2 is buckled. Therefore, the second roller 123 cannot be driven by the media 2 to rotate normally. Furthermore, the grating wheel 1250 cannot be driven by the first roller 122 to rotate at the predetermined rotating speed. Therefore, the light receiving component 1252 cannot correctly receive the light emitted by the light emitting component 1251 and cannot generate the sensing signal corresponding to the predetermined rotating speed. In such a way, the control unit 126 can determine that the media 2 does not proceed along the passage P at the predetermined speed according to the sensing signal generated by the light receiving component 1252, so as to determine the paper jam condition occurs inside the passage P.

In contrast to the prior art, in the present disclosure, when the media proceeds along the passage, the media drives the second roller to rotate the first roller to rotate the grating wheel, so that the control unit can determine whether the media proceeds along the passage at the predetermined speed according to the sensing signal generated by the light receiving component during rotation of the grating wheel. In such a way, such mechanism can determine that a paper jam condition occurs when the control unit determines the media does not process along the passage at the predetermined speed. Furthermore, in the present disclosure, there is only the second roller rotatably contacting with the media, which effectively prevents interference of feeding and reduces a possibility of the paper jam condition.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A sensing device adapted for detecting paper jam conditions, the sensing device comprising:

a housing;

a supporting component movably disposed on the housing;

a grating module installed inside the housing, the grating module comprising:

a grating wheel rotatably disposed on the supporting component;

a light emitting component for emitting light;

a light receiving component for receiving the light emitted by the light emitting component to generate a corresponding sensing signal;

a first roller disposed coaxially with the grating wheel and for driving the grating wheel to rotate;

a second roller contacting with the first roller and for driving the first roller to rotate, when a media contacts with the second roller, the second roller driving the first roller to move the supporting component relative to the housing according to a thickness of the media, so as to adjust positions of the first roller and the grating wheel relative to the housing, and the second roller driving the first roller to rotate the grating wheel when the media drives the second roller to rotate; and a control unit electrically connected to the light emitting component and the light receiving component, the control unit determining whether the media proceeds at a predetermined speed according to the corresponding sensing signal generated by the light receiving component during rotation of the grating wheel.

2. The sensing device of claim 1, wherein the light emitting component and the light receiving component are disposed on the two opposite sides of the grating wheel, a plurality of apertures is formed on a periphery of the grating wheel at intervals, and the light emitted by the light emitting component passes through the plurality of apertures to the light receiving component.

3. The sensing device of claim 1, wherein the light emitting component and the light receiving component are disposed on a same side of the grating wheel, a plurality of reflecting sections is formed on a periphery of the grating wheel at intervals, and the light emitted by the light emitting component is reflected to the light receiving component by the plurality of reflecting sections.

4. The sensing device of claim 1, further comprising a recovering component disposed between the supporting component and the housing and for driving the supporting component to recover.

5. The sensing device of claim 1, wherein at least one slot is formed on the housing, and the supporting component comprises at least one sliding portion slidably installed inside the at least one slot.

6. The sensing device of claim 1, wherein when the second roller rotates along a first rotating direction, the second roller drives the first roller to rotate along a second rotating direction opposite to the first rotating direction to simultaneously drive the grating wheel to rotate along the second rotating direction.

7. An office apparatus comprising:

a main body, a passage being formed inside the main body;

a driving roller assembly disposed inside the main body and for driving a media to move along the passage; and a sensing device for determining whether the media proceeds along the passage normally, the sensing device comprising:

a housing disposed inside the main body;

a supporting component movably disposed on the housing;

a grating module installed inside the housing, the grating module comprising:

a grating wheel rotatably disposed on the supporting component;

a light emitting component for emitting light;

a light receiving component for receiving the light emitted by the light emitting component to generate a corresponding sensing signal;

a first roller disposed coaxially with the grating wheel and for driving the grating wheel to rotate;

a second roller contacting with the first roller and for driving the first roller to rotate, when the media contacts with the second roller, the second roller driving the first roller to move the supporting component relative to the housing according to a thickness of the media, so as to adjust positions of the first roller and the grating wheel relative to the housing, and the second roller driving the first roller to rotate the grating wheel when the media drives the second roller to rotate; and a control unit electrically connected to the light emitting component and the light receiving component, the control unit determining whether the media proceeds at a predetermined speed according to the corresponding sensing signal generated by the light receiving component during rotation of the grating wheel.

8. The office apparatus of claim 7, wherein the light emitting component and the light receiving component are disposed on the two opposite sides of the grating wheel, a plurality of apertures is formed on a periphery of the grating wheel at intervals, and the light emitted by the light emitting component passes through the plurality of apertures to the light receiving component.

9. The office apparatus of claim 7, wherein the light emitting component and the light receiving component are disposed on a same side of the grating wheel, a plurality of reflecting sections is formed on a periphery of the grating wheel at intervals, and the light emitted by the light emitting component is reflected to the light receiving component by the plurality of reflecting sections.

10. The office apparatus of claim 7, wherein the sensing device further comprises a recovering component disposed between the supporting component and the housing and for driving the supporting component to recover.

11. The office apparatus of claim 7, wherein at least one slot is formed on the housing, and the supporting component comprises at least one sliding portion slidably installed inside the at least one slot.

12. The office apparatus of claim 7, wherein when the second roller rotates along a first rotating direction, the second roller drives the first roller to rotate along a second rotating direction opposite to the first rotating direction to simultaneously drive the grating wheel to rotate along the second rotating direction.

13. The office apparatus of claim 7, wherein the second roller and the driving roller assembly are disposed on two opposite sides of the passage.

* * * * *